US012161912B1

(12) United States Patent
Hinkle

(10) Patent No.: US 12,161,912 B1
(45) Date of Patent: Dec. 10, 2024

(54) THERAPEUTIC, REHABILITATION, AND STRENGTHENING DEVICE

(71) Applicant: John Hinkle, Golden, CO (US)

(72) Inventor: John Hinkle, Golden, CO (US)

( * ) Notice: Subject to any disclaimer, the term of this patent is extended or adjusted under 35 U.S.C. 154(b) by 0 days.

(21) Appl. No.: 18/383,788

(22) Filed: Oct. 25, 2023

(51) Int. Cl.
*A63B 23/16* (2006.01)
*A63B 21/00* (2006.01)

(52) U.S. Cl.
CPC ..... *A63B 23/16* (2013.01); *A63B 21/4035* (2015.10)

(58) Field of Classification Search
CPC ..... A63B 23/16; A63B 21/4035
See application file for complete search history.

(56) References Cited

U.S. PATENT DOCUMENTS 881,438 A * 3/1908 Nohl ..... A63B 23/16 482/50
2,817,524 A * 12/1957 Sadler ..... A63B 23/12 482/118
3,730,523 A * 5/1973 McRae ..... A63B 21/028 482/49
4,973,043 A * 11/1990 Nolan ..... A63B 23/14 482/106
5,092,588 A * 3/1992 DeLuca ..... A63B 21/072 482/109
6,024,660 A * 2/2000 Romanick ..... A63B 71/06 473/451
7,008,351 B2 * 3/2006 Parker ..... A63B 21/0004 482/148
D725,206 S * 3/2015 Johnston ..... D21/713
9,480,876 B1 * 11/2016 Blacklock ..... A63B 21/00072
2006/0183608 A1 * 8/2006 Sumner ..... A63B 15/00 482/109
2021/0008847 A1 * 1/2021 Hsiao ..... A63B 21/028
2022/0305361 A1 * 9/2022 Ross ..... A63B 69/0002

FOREIGN PATENT DOCUMENTS

CN 111921169 A * 11/2020 ..... A61H 1/0288

OTHER PUBLICATIONS

Lance, Easy Ball Mount Removal, Published Sep. 19, 2017, <URL: https://www.youtube.com/watch?v=4n9_1tB9-pc> (Year: 2017).*

* cited by examiner

*Primary Examiner* — Zachary T Moore
(74) *Attorney, Agent, or Firm* — J. Miguel Hernandez; James R. Gourley; Carstens, Allen & Gourley, LLP

(57) ABSTRACT

The invention relates to a device used for physical therapy, rehabilitation, or strengthening of the hands, arms, wrists, shoulders, elbows, or fingers of a user. The device is a ball with a stem extending from a surface of the ball, and a rotatable member that is rotatably engaged with the stem. The physical therapy, rehabilitation, or strengthening exercises are performed when the user holds the ball in the user's hand while using the fingers of that hand to rotate the rotatable member on the stem.

4 Claims, 4 Drawing Sheets

THERAPEUTIC, REHABILITATION, AND STRENGTHENING DEVICE

CROSS REFERENCE TO RELATED APPLICATION

[RESERVED].

BACKGROUND OF THE INVENTION

Technical Field

The present invention relates to an apparatus for enabling physical therapy, rehabilitation, and strengthening exercises to be performed for the muscles and other tissues in the hands, arms, wrists, shoulders, elbows, or fingers.

SUMMARY OF THE INVENTION

In one embodiment, a device comprises: a ball; a stem extending from a surface of the ball; and a rotatable member rotatably engaged with the stem.

In another embodiment, the stem extends in a radial direction from the surface of the ball.

In another embodiment, the stem is a male threaded member and the rotatable member is a female threaded nut.

In another embodiment, the rotatable member is rotatably engaged with the stem via a bearing.

In another embodiment, a resistance to rotation of the rotatable member is adjustable.

In another embodiment, the resistance to rotation is adjustable via a screw located at a distal end of the stem.

In another embodiment, the ball is a sports ball, such as a baseball, a softball, or a golf ball.

In another embodiment, the ball is a spherical ball sized to fit within a human hand.

In another embodiment, the stem and rotatable member rotate together around a single axis.

In one embodiment, a method of using the embodiments described above comprises: holding the ball in a hand of a user; and rotating the rotatable member with the fingers of the user's hand while holding the ball in the user's hand.

In another embodiment, the method comprises: rotating the rotatable member at different distances from the surface of the ball.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

The present invention is directed to a method and apparatus for providing physical therapy, rehabilitation, and strengthening to the hands, arms, wrists, shoulders, elbows, or fingers of humans. Generally, the invention comprises a ball meant to be held within the hand of the user. Preferably, the ball is a sports ball. The ball has a stem protruding from at least one surface of the ball, and the stem is engaged with a rotatable member configured to rotate about the axis of the stem. The physical therapy, rehabilitation, or strengthening of the arms or hands of the user is accomplished by manipulating or rotating the rotatable member one direction or the other with the user's fingers while holding the ball within the hand of the user. These general concepts can be accomplished by way of numerous variations and embodiments, some of which are described below.

Figure 1:
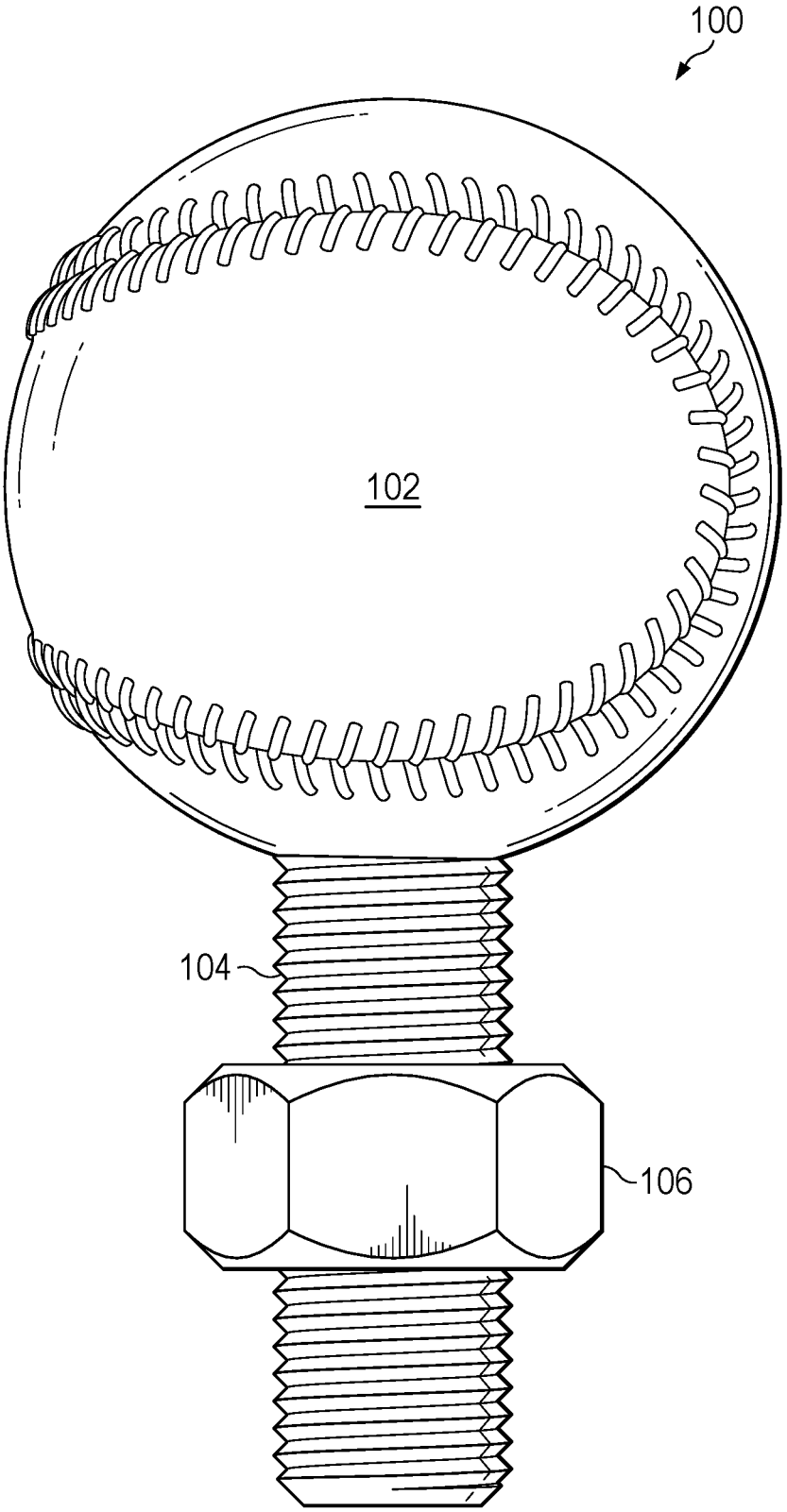
FIG. 1 is a plan view of one embodiment of the present invention.

FIG. 1 depicts a plan view of one embodiment 100 of the present invention. A ball 102 has a stem 104 extending from one surface of the ball 102. In a preferred embodiment, the central axis of the stem extends in a radial direction from the surface of the ball. In the embodiment shown in FIG. 1, the ball is depicted as a baseball, but any type of ball may be used in accordance with the present invention. For example, a softball, golf ball, football, tennis ball, whiffle ball, or any ball that fits within a human hand may be used. Smaller or larger balls can be used, depending on the size and strength of the user's hands. Balls of different weights may also be used depending on whether the user desires rehabilitation of an injury (which depending on the injury, could call for a lighter weight ball) or strength training (for which a heavier weight ball might be beneficial).

FIG. 1 also depicts a rotatable member 106 engaged with the stem 104. In the preferred embodiment depicted in FIG. 1, the stem is a male threaded stem, and the rotatable member is a female threaded nut engaged with the male threaded stem. When a user of the embodiment depicted in FIG. 1 manipulates or rotates the rotatable member around the stem, the rotatable member will travel towards or away from the ball. This embodiment is advantageous for efficient and effective physical therapy, rehabilitation, or strengthening exercises because different muscles are worked in different ways when the rotatable member is close to the ball or further away from the ball.

Figure 2:
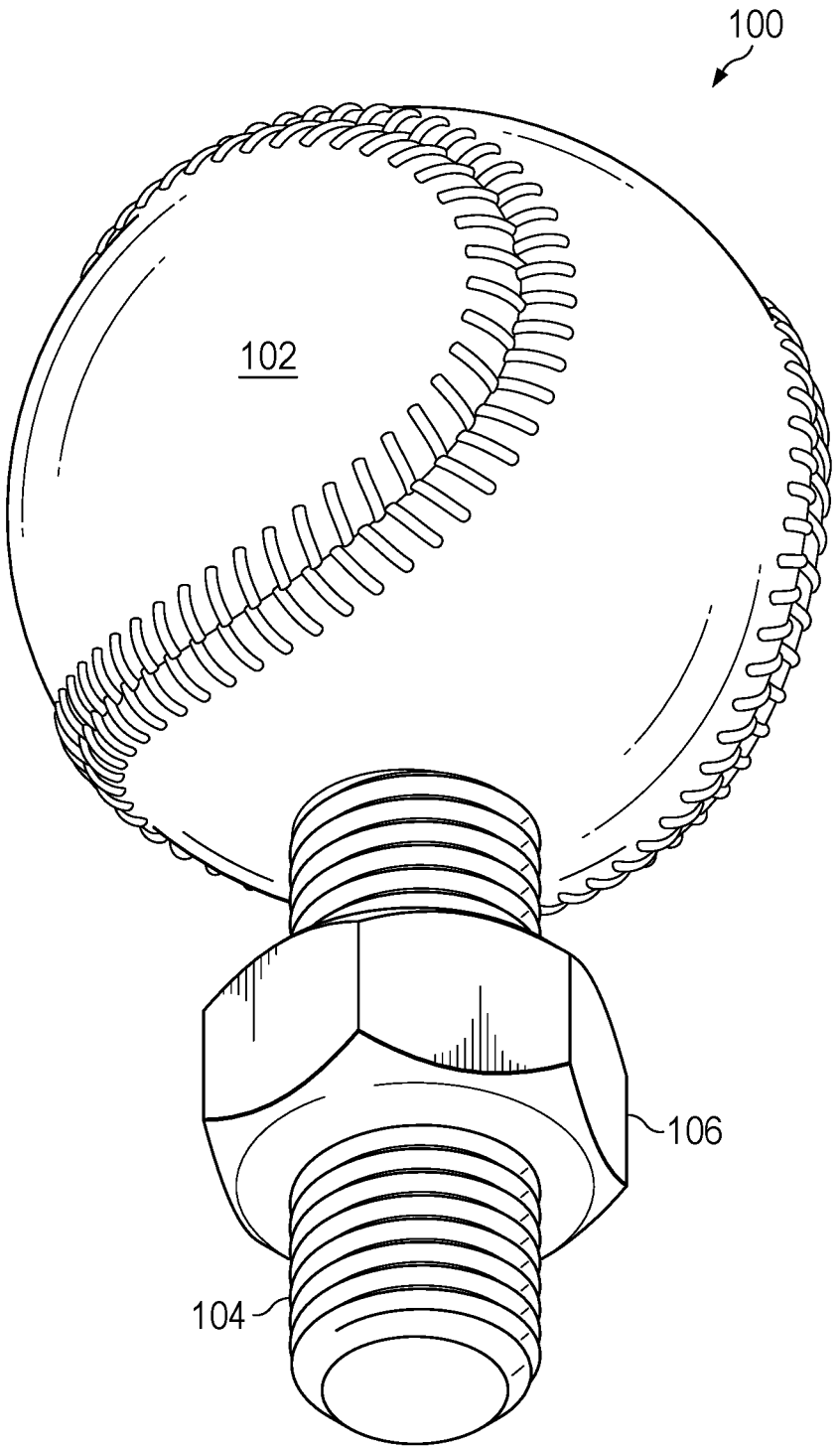
FIG. 2 is a perspective view of one embodiment of the present invention.

FIG. 2 depicts a perspective view of the embodiment depicted in FIG. 1. The male threaded stem is shown ending at a distal end at a flat surface.

Figure 3:
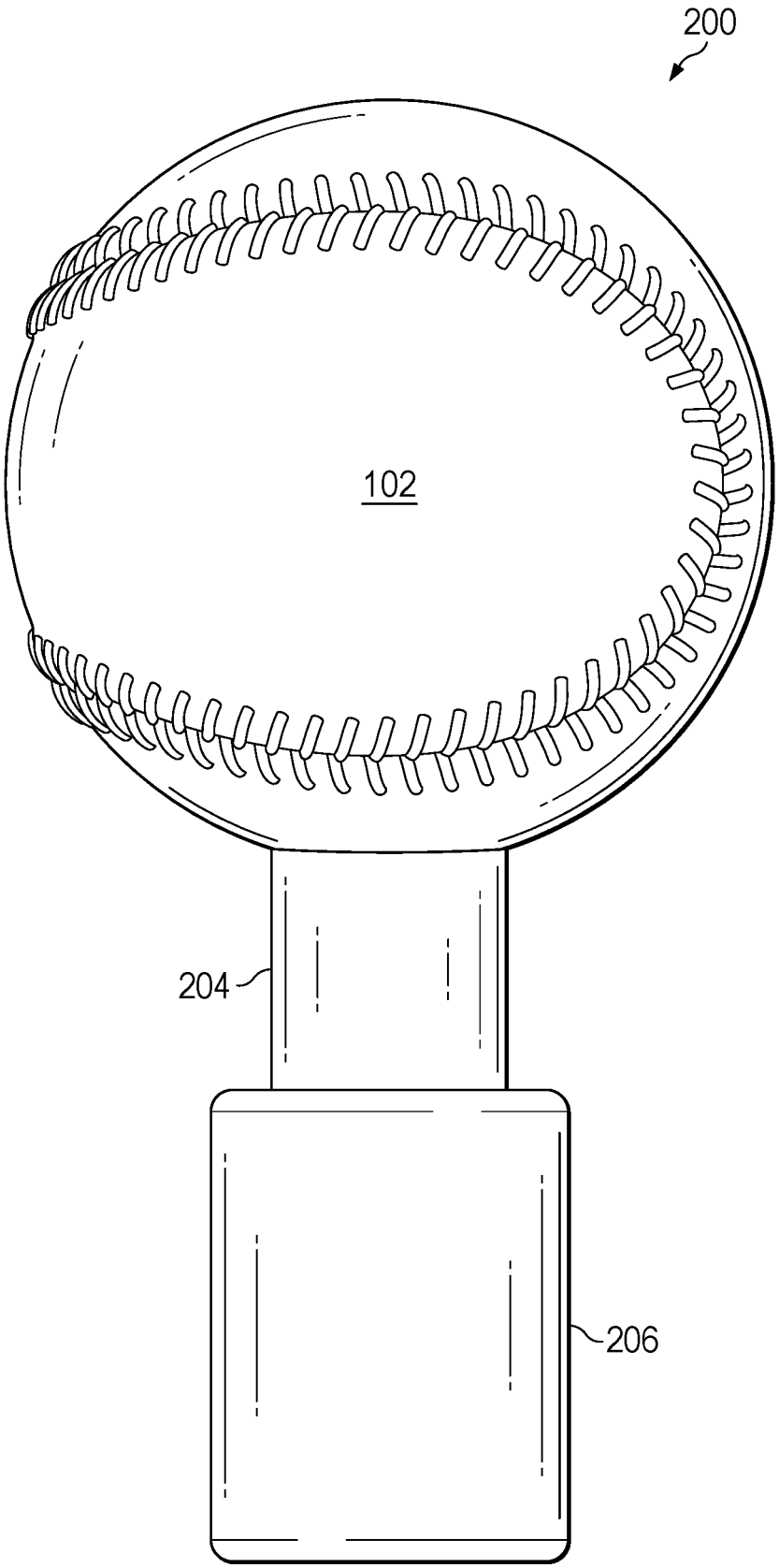
FIG. 3 is a plan view of another embodiment of the present invention.

FIG. 3 shows a different embodiment of the invention. In the embodiment depicted in FIG. 3, the stem 204 extending from the surface of the ball 102 is not threaded. Instead, the rotatable member 206 is rotatably engaged with the stem 204 without the use of a threaded connection. For example, the rotatable member 206 may be rotatably engaged with the stem 204 via a bearing 207 fit within the rotatable member 206 and on the exterior of the stem 206. Other rotatable mechanical connections are possible with this embodiment, or combined with other embodiments.

In the embodiment in FIG. 3, the rotatable member does not move toward or away from the ball as the user manipulates or rotates the rotatable member. This embodiment can provide the user with more consistency and repeatability in physical therapy, rehabilitation, or strengthening exercises that are performed. This embodiment may also allow for similar advantages to the embodiment in FIG. 1 by providing a rotatable member that is long in the axial direction, so that a user may manipulate or rotate the rotatable member by touching a surface of the rotatable member that is closer to the ball, or further away from the ball, as desired to work different muscles, tissues, and joints.

Figure 4:
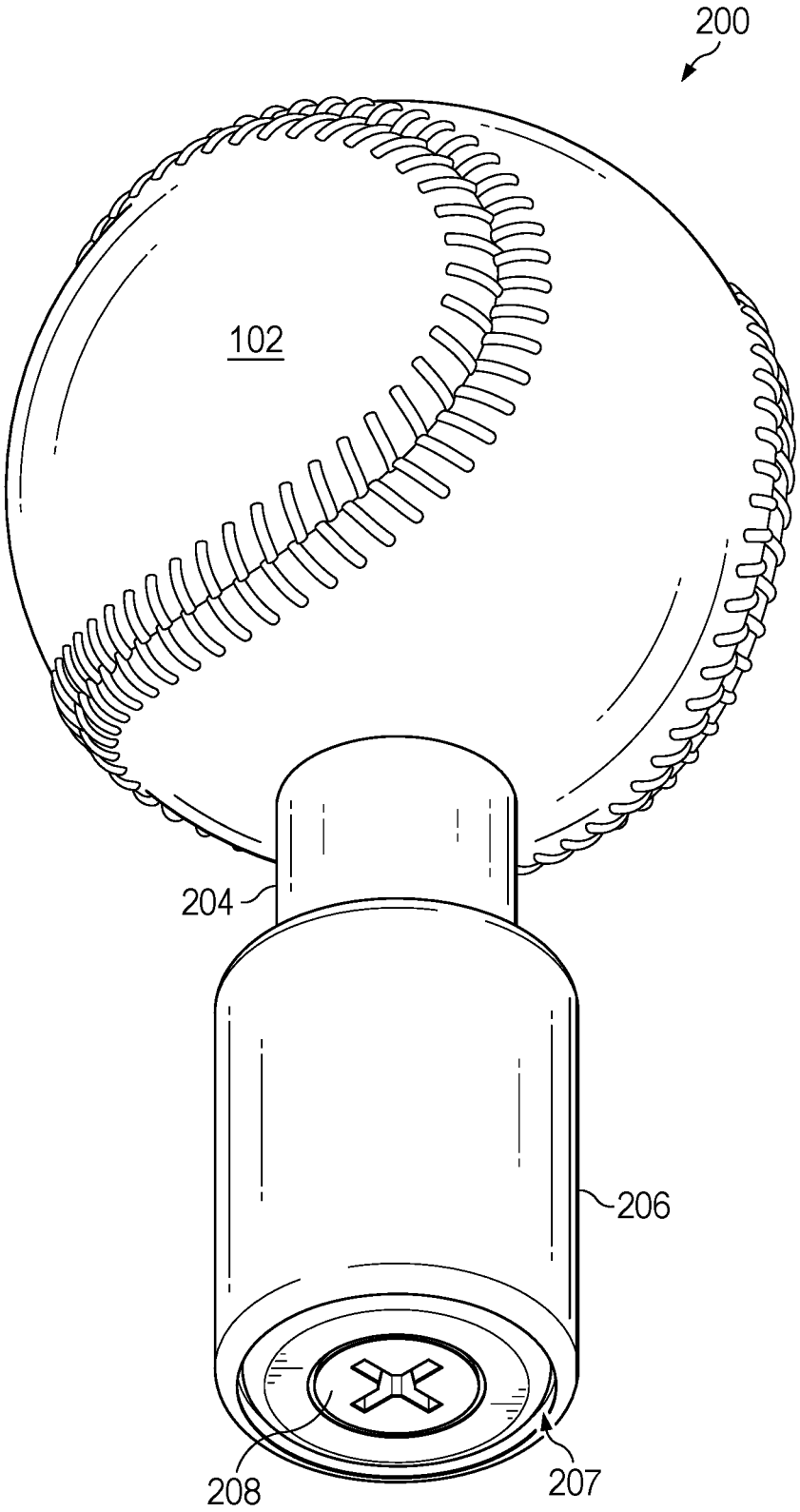
FIG. 4 is a perspective view of another embodiment of the present invention.

FIG. 4 depicts a perspective view of the embodiment depicted in FIG. 3. As shown in FIG. 4, this embodiment may include an adjustable resistance member 208, such as a screw, that may be turned in one direction or another to provide more or less resistance to rotation. For example, if the screw 208 in the embodiment of FIG. 4 is turned clockwise or tightened, it places additional pressure on the rotatable member and the stem, thereby resisting rotation. By the same token, the screw 208 in FIG. 4 may be loosened or turned counterclockwise in order to place less pressure on the rotatable member and stem, thereby reducing the resistance to rotation and allowing the rotatable member to rotate more freely. This feature may be beneficial to some users who may desire more or less resistance to rotation for certain exercises or therapies. For example, a user who has recently sustained an injury may desire less resistance at the beginning of the recovery and rehabilitation process. Alternatively, a user who is using the invention to strengthen a healthy arm or hand, or a user who is further along in the process of recovering from an injury, may desire more resistance to rotation for their exercises or therapies.

The resistance adjustment mechanism 208 depicted in FIG. 4 is not the only possible way to provide for adjustable resistance to rotation. For example, in the embodiment of FIGS. 1 and 2, a rotatable member made of different material having a different coefficient of friction against the stem may be used to provide different rotational resistances. For example, rotatable members made of certain different types of plastics or metals may provide different resistances to rotation against the stem of those embodiments. Additionally, a lubricant can be provided between the rotatable member and threaded stem to reduce the resistance for users who desire reduced resistance. Similarly, the embodiment of FIGS. 3 and 4 may provide for removeable and replaceable rotatable members made of different materials to provide different resistances to rotation.

In a different embodiment, the rotatable member is fixed to the stem, and the rotatable member and stem may rotate together. In this embodiment, the stem would be attached to a bearing or similar located within the ball.

The exercise or therapeutic methods enabled by the present invention can involve the user either holding the ball within the user's hand and spinning the rotatable member with the fingers, or alternatively holding the rotatable member in the user's hands and spinning the ball with the user's fingers, depending on the nature of the therapy or exercise desired by the user.

It will now be evident to those skilled in the art that there has been described herein ball with a stem extending from a surface of the ball, and a rotatable member engaged with the stem. Although the invention hereof has been described by way of preferred embodiments, it will be evident that other adaptations and modifications can be employed without departing from the spirit and scope thereof. The terms and expressions employed herein have been used as terms of description and not of limitation; and thus, there is no intent of excluding equivalents, but on the contrary it is intended to cover any and all equivalents that may be employed without departing from the spirit and scope of the invention.

In sum, while this invention has been particularly shown and described with reference to a preferred embodiment, it will be understood by those skilled in the art that various changes, in form and detail may be made therein without departing from the spirit and scope of the invention.

I claim:

1. A method of using an exercise device, wherein the exercise device consists of a ball, a stem extending from a surface of the ball, and a rotatable member rotatably engaged with the stem, the method comprising:

holding the ball in a hand of a user; and rotating the rotatable member with fingers of the user's hand while holding the ball in the user's hand.

2. The method of claim 1 further comprising rotating the rotatable member at different distances from the surface of the ball.

3. A method of exercising comprising:

holding a ball in a hand of a user, wherein the ball has a stem extending from a surface of the ball and a rotatable member rotatably engaged with the stem; and rotating the rotatable member with fingers of the user's hand while holding the ball in the user's hand.

4. A method of exercising comprising:

holding a sports ball in a hand of a user, wherein the sports ball has a male threaded stem extending radially from a surface of the ball and a rotatable member rotatably engaged with the stem; and rotating the rotatable member with fingers of the user's hand while holding the ball in the user's hand.

* * * * *